US007794231B2

(12) United States Patent
Yuan et al.

(10) Patent No.: US 7,794,231 B2
(45) Date of Patent: Sep. 14, 2010

(54) ELECTRICAL CONNECTOR

(75) Inventors: Wei Yuan, ShenZhen (CN); Yu-San Hsiao, Tu-cheng (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 66 days.

(21) Appl. No.: 12/221,818

(22) Filed: Aug. 6, 2008

(65) Prior Publication Data

US 2009/0042409 A1 Feb. 12, 2009

(30) Foreign Application Priority Data

Aug. 6, 2007 (CN) ..... 2007 1 0025838

(51) Int. Cl.
*H01R 12/00* (2006.01)

(52) U.S. Cl. ..... 439/59

(58) Field of Classification Search ..... 439/59, 439/700, 500, 287, 544, 578
See application file for complete search history.

(56) References Cited

U.S. PATENT DOCUMENTS 5,961,356 A * 10/1999 Fekete ..... 439/700
2007/0298653 A1* 12/2007 Mahoney et al. ..... 439/578
2008/0188109 A1* 8/2008 Hawkins et al. ..... 439/287

* cited by examiner

*Primary Examiner*—Alexander Gilman
(74) *Attorney, Agent, or Firm*—Wei Te Chung; Andrew C. Cheng; Ming Chieh Chang

(57) ABSTRACT

An electrical connector comprises a terminal block, a terminal received in the terminal block and an elastic connecting portion electrically connecting with the terminal. The terminal block defines a first receiving cavity, a second receiving cavity opposite to the first receiving cavity and a spaced portion spacing the first receiving cavity and the second receiving cavity. The spaced portion defines a receiving channel and a inserting slot communicating with the receiving channel. The elastic connecting portion is received in the second receiving cavity and electrically connects with the terminal.

17 Claims, 5 Drawing Sheets

ELECTRICAL CONNECTOR

BACKGROUND OF THE INVENTION

1. Field of the Invention

The present invention relates to an electrical connector, and particularly to an electrical connector adapting for a wireless card.

2. Description of the Prior Art

In recent years, the various wireless technologies develop quickly such as IrDA, IEEE 802.11b, 802.11a, 802.11g, 802.11n, Bluetooth and so on. Many people are eager to cast off various cables connecting with coupling devices. The wireless technologies bring human being so much convenience. Many wireless products such as wireless keyboard, wireless mouse, wireless headset, enter into daily life. A traditional way to mount a wireless card into a electronic device is by a solder manner. However, these electronic devices are usually so small, and it's a hard and time-consuming work to operate within small space. In addition, it's not convenient to change the wireless card when necessary.

Hence, an new designed electrical connector is desired to overcome the disadvantages of the prior art.

BRIEF SUMMARY OF THE INVENTION

Therefore, a main object of the present invention is to provide an electrical connector with simple structure and high efficiency in process of assembly.

To fulfill the above-mentioned object, an electrical connector according to the present invention comprises a terminal block, a terminal received in the terminal block and an elastic connecting portion electrically connecting with the terminal. The terminal block defines a first receiving cavity, a second receiving cavity opposite to the first receiving cavity and a spaced portion spacing the first receiving cavity and the second receiving cavity. The spaced portion defines a receiving channel and a inserting slot communicating with the receiving channel. The elastic connecting portion is received in the second receiving cavity and electrically connects with the terminal.

Other objects, advantages and novel features of the invention will become more apparent from the following detailed description when taken in conjunction with the accompanying drawings.

BRIEF DESCRIPTION OF THE DRAWINGS

The foregoing summary, as well as the following detailed description of the embodiments of the present invention, will be better understood when read in conjunction with the appended drawings. For the purpose of illustrating the invention, there are shown in the drawings embodiments which are presently preferred. As should be understood, however, the invention is not limited to the precise arrangements and instrumentalities shown. In the drawings.

DETAILED DESCRIPTION OF THE PREFERRED EMBODIMENT

Reference will now be made in detail to the preferred embodiment of the present invention.

Figure 1:
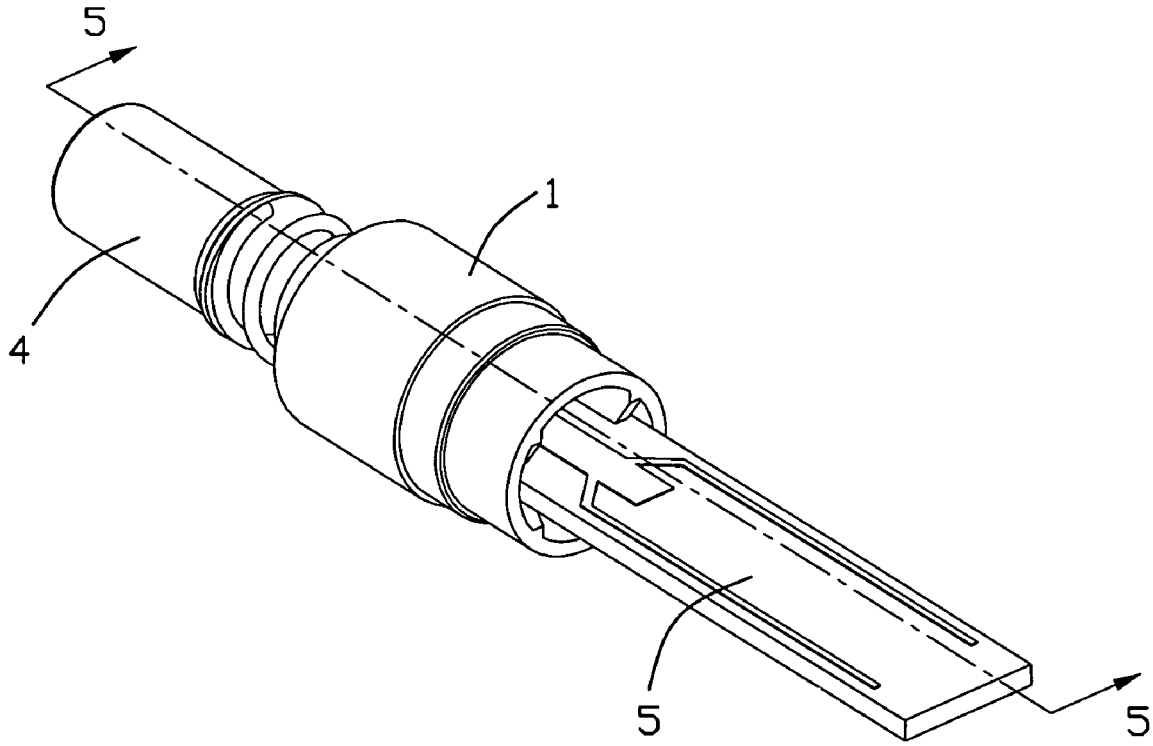
FIG. 1 is an perspective view of an electrical connector according to the present invention assembled with a wireless card.
Figure 2:
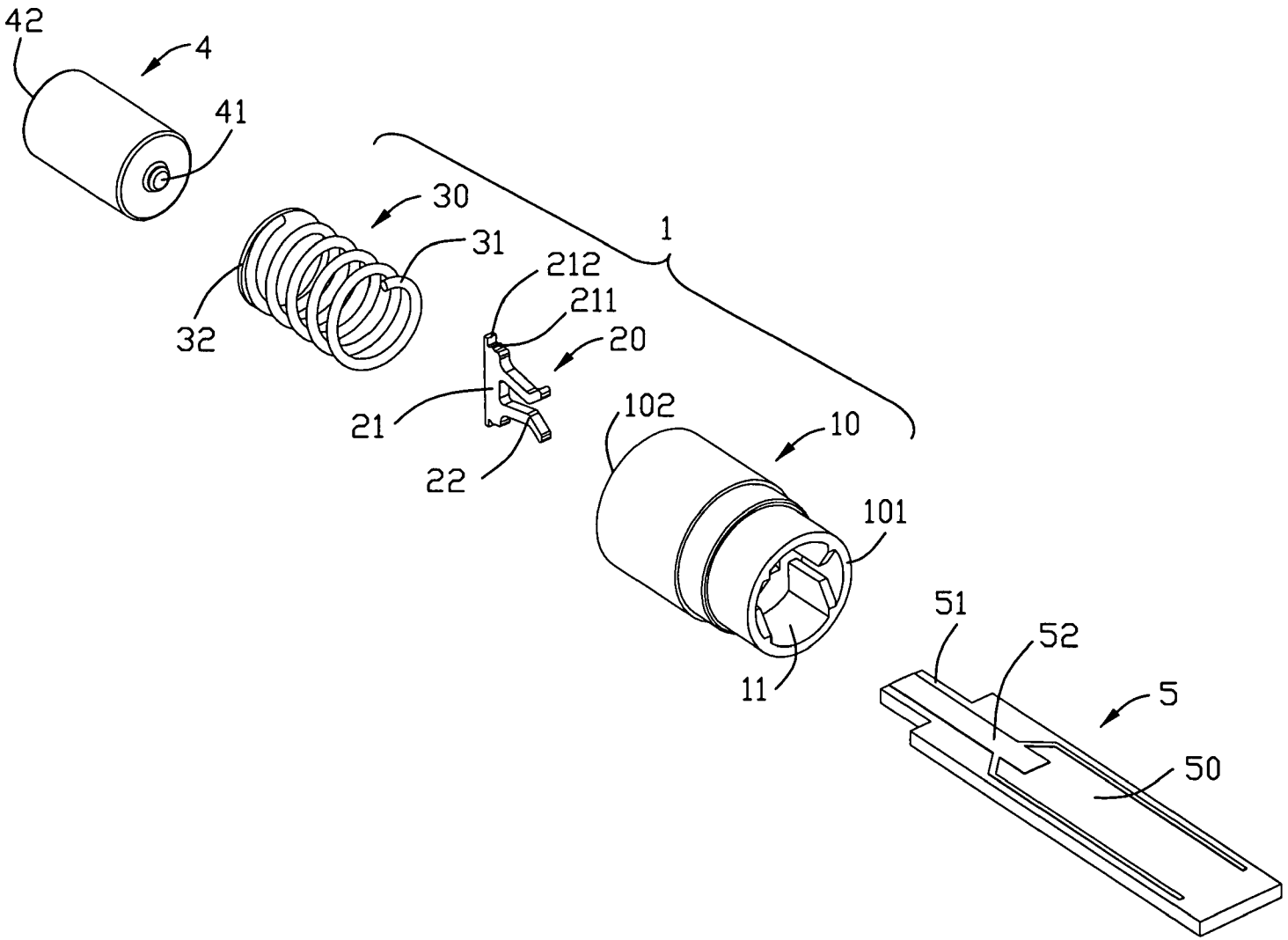
FIG. 2 is an exploded, perspective view of an electrical connector according to the present invention with a wireless card.
Figure 3:
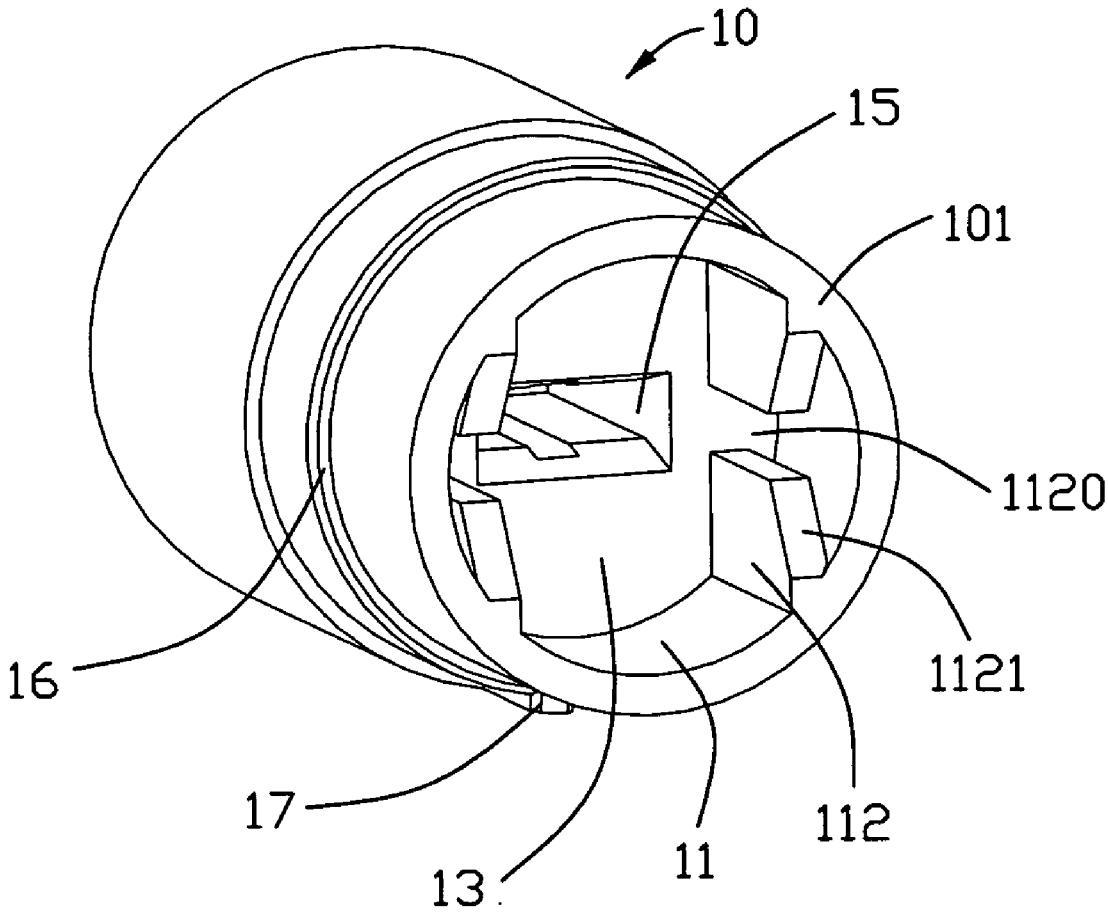
FIG. 3 is a perspective view of a terminal block of the electrical connector according to the present invention.
Figure 4:
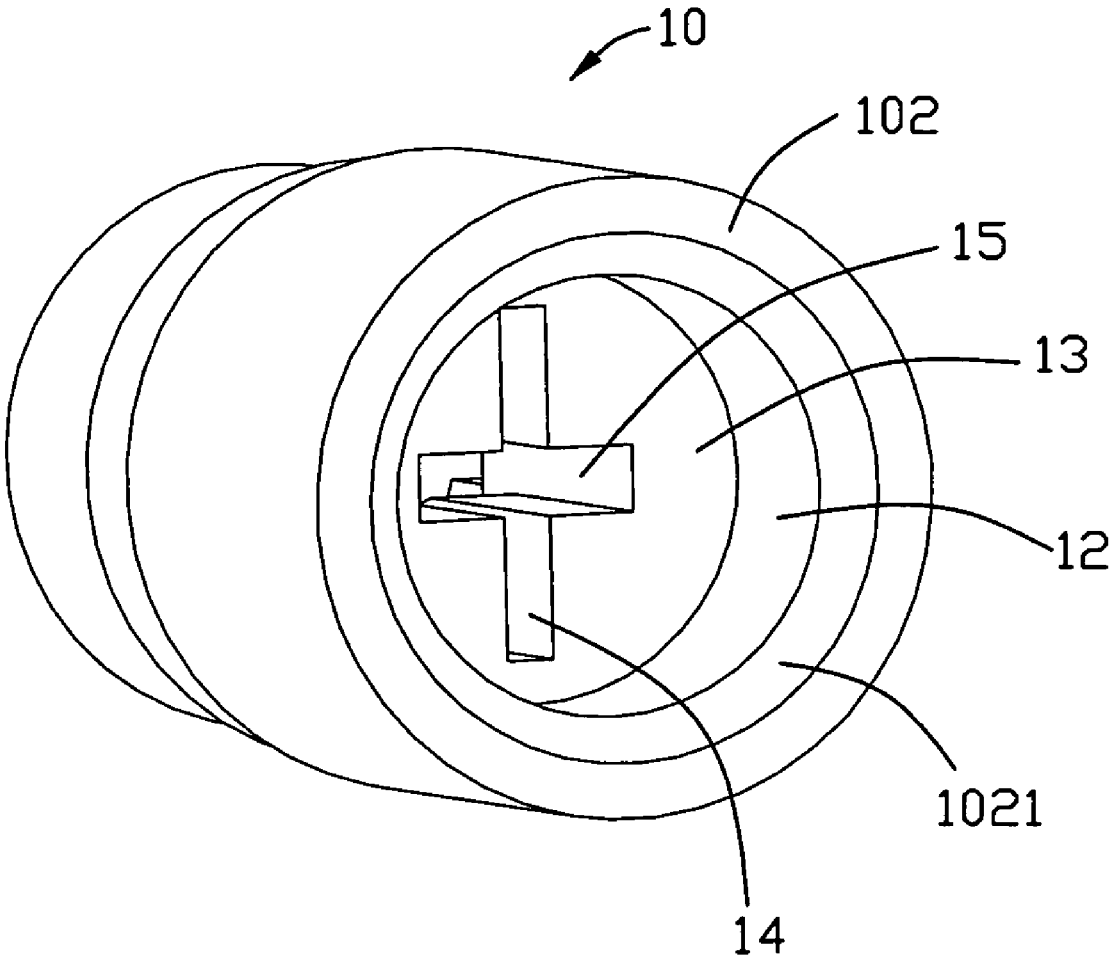
FIG. 4 is a view similar to FIG. 3, but taken from different aspect.
Figure 5:
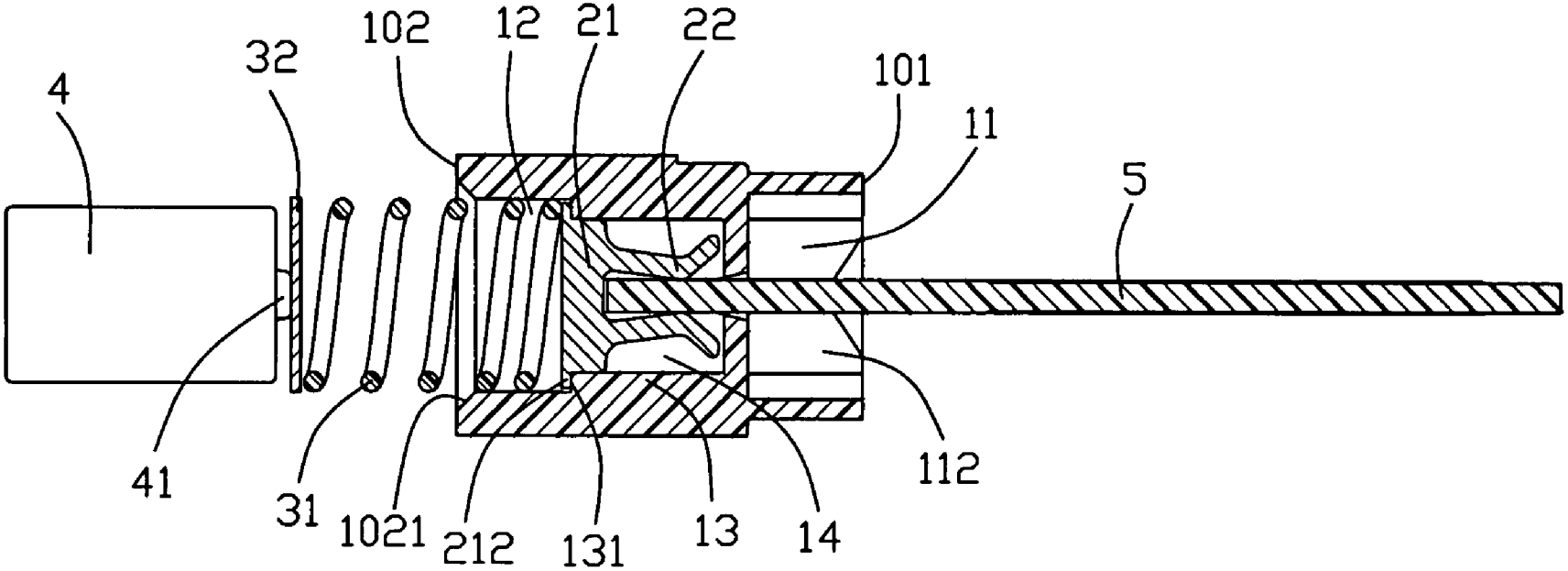
FIG. 5 a cross-sectional view of FIG. 1, taken along line 5-5.

Referring to FIGS. 1-2, an electrical connector 1 according to the present invention is adapted for connecting a battery 4 and a wireless card 5. The electrical connector 1 comprises an terminal block 10, a terminal 20 disposed therein, an elastic connecting portion 30 received in the terminal block 10 and electrically connecting with the terminal 20. The battery 4 has a positive electrode 41 and a negative electrode 42. The wireless card 5 comprises an elongated base 50, a contacting portion 51 extending forwardly from the base 50 and a conductive path 52 disposed on the base 50 and the contacting portion 51.

Referring to FIGS. 2-5, the terminal block 10 is substantially elongated and columnar, and defines a mating face 101 at the front thereof and a engaging face 102 opposite to the mating face 201. The terminal block 10 comprises a first receiving cavity 11 with columnar shape and concaved inwardly from the mating face 101, a second receiving cavity 12 with columnar shape and concaved inwardly from the engaging face 102 and a spaced portion 13 located between the first receiving cavity 11 and the second receiving cavity 12. The first receiving cavity 11 defines a plurality of blocks 112 spaced toward each other, and said each pair blocks 112 together define a limiting space 1120. Each block 112 defines a slant surface 1121 inclined toward the limiting space 1120. The engaging face 102 defines a guiding face 1021. The spaced portion 13 defines a receiving channel 14 extending along a direction from the engaging face 102 to the mating face 101 by a certain distance shorter than the thick of the spaced portion 13 and an inserting slot 15 passing through the spaced portion 13 and communicating with the first receiving cavity 11 and the second receiving cavity 12. The pair of limiting space 1120 symmetrically locate at two opposite sides of the inserting slot 15. The inserting slot 15 is perpendicular to the receiving channel 14. In the preferred embodiment, the point of the intersection of the inserting slot 15 and the receiving channel 14 is in a same line with the center of a circle of the first receiving cavity 11 and the second receiving cavity 12. The width of the receiving channel 14 perpendicular to the longitudinal direction is smaller than the diameter of the first second receiving cavity 11 thereby a supporting step 131 is formed. In the preferred embodiment, the electrical connector 1 defines a stepping portion 16 around the periphery thereof and a positioning clump 17 protruding outwardly from the stepping portion 16 for reliable mounting into a electronic device.

The terminal 20 is of symmetrical configuration, and comprises a main portion 21, a pair of projections 212 located at two lateral sides of the rear end of the main portion 21, and a pair of resilient contacting arms 22 symmetrically extending forwardly from the two lateral sides of the front end of the main portion 21. In addition, the main portion 21 respectively defines a locking portion 211 engaging within the receiving channel 14.

The elastic connecting portion 30 comprises a elastic element 31 and a contacting element 32 electrically connecting with the elastic element 31. In the preferred embodiment, the elastic element 31 is a metal spring featured in the diameter of one end thereof larger than that of the another end thereof. In a alternative embodiment, the elastic element 31 also can be other shaped elastic conductive element. The contacting element 32 is a metal pad soldered with the elastic element 31. The elastic connecting portion 30 can be integrally made from a metal sheet.

Referring to FIGS. 1-5, in assembly, the terminal 20 is assembled into terminal block 10 along a direction from the engaging face 102 to the mating face 101 with the main portion 21 and the pair of contacting arms 22 disposed within the receiving channel 14, the pair of the locking portions 211 resisting against the inner wall of the receiving channel 14 for preventing the terminal 20 from withdrawing backwardly, the pair of the projections 212 resisting against the supporting step 131 for preventing the terminal 20 from moving forwardly and the elastic contacting arms 22 protruding into the inserting slot 15. Then, the elastic connecting portion 30 is assembled into the terminal block 10 and led by the guiding face 1021 of the engaging face 102 of the terminal block 10. The elastic connecting portion 30 is reliably positioned in the second receiving cavity 23 because of the diameter of one end of the elastic connecting portion 30 is slight larger than that of the second receiving cavity 12. The contacting element 32 of the elastic connecting portion 30 is beyond the second receiving cavity 12. Accordingly, the assembly of the electrical connector is completed.

In the process of usage, the electrical connector 1 according to the present invention is assembled into an electronic device (not shown) with the stepping portion 16 and the positioning clump 17 cooperating with the electronic device. The electrical connector 1 is electrically connecting with the battery 4 located in the electronic device by elastic connecting portion 30. The wireless card 5 is inserted into the first receiving cavity 11 and the inclined face 1121 of the blocks 112 guide the base 50 of the wireless card 5 into the limiting spaces 1120 thereby the inserting portion 51 can be precisely inserted into the inserting slot 15 with the conductive path 52 electrically connecting with the resilient arms 22 of the terminal 20. In addition, the limiting spaces 1120 have the function for positioning the wireless card 5. Thus, the electrical connector 1 according to present invention has many advantages, such as simple structure, high efficiency in process of assembly and flexible change if necessary.

It is to be understood, however, that even though numerous, characteristics and advantages of the present invention have been set fourth in the foregoing description, together with details of the structure and function of the invention, the disclosed is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector, comprising:

a terminal block defining a first receiving cavity, a second receiving cavity opposite to the first receiving cavity and a spaced portion spacing the first receiving cavity and the second receiving cavity, said spaced portion defining a receiving channel and an inserting slot communicating with the receiving channel, the first receiving cavity defining a plurality of spaced blocks, and each two blocks together forming a limiting space therebetween;

a terminal assembled to the receiving channel of the terminal block; and an elastic connecting portion received in the second receiving cavity and electrically connecting with the terminal.

2. The electrical connector as claimed in claim 1, wherein the limiting spaces symmetrically locate at two sides of the inserting slot.

3. The electrical connector as claimed in claim 2, wherein the terminal block is elongated and columnar, and defines a mating face and an engaging face opposite to the mating face; the first receiving cavity concaves inwardly from the mating face at a certain distance and the second receiving cavity concaves inwardly from the engaging face at a certain distance and toward the first receiving cavity.

4. The electrical connector as claimed in claim 3, wherein the receiving channel extends along a longitudinally direction of the terminal block and does not pass through the spaced portion, said receiving channel communicates with the second receiving cavity, said inserting slot communicates with the first receiving cavity, the second receiving cavity and the receiving channel along a longitudinal direction.

5. The electrical connector as claimed in claim 1, wherein the terminal comprises an elongated main portion and a pair of resilient contacting arms respectively extending forwardly from two lateral sides of the main portion.

6. The electrical connector as described in claim 5, wherein the resilient contacting arms of the terminal are received in the receiving channel and exposed in the inserting slot.

7. The electrical connector as claimed in claim 6, wherein the terminal comprises a pair of projections located at two rear sides of the main portion and resisting against one surface of the spaced portion and a pair of locking portions protruding from the two lateral sides of the main portion and engaging with the inner wall of the receiving channel.

8. The electrical connector as claimed in claim 1, wherein the elastic connecting portion comprises an elastic conductive element and a contacting element electrically connecting with the elastic conductive element, said elastic conductive element received in the second receiving cavity and electrically connecting with the terminal, and the contacting element remains outside of the second receiving cavity.

9. An electrical connector, comprising:

a terminal comprising a main portion and a pair of resilient contacting arms extending from one side of the main portion, the two resilient contacting arms facing to each other along a first direction;

a columnar terminal block defining a mating face and an engaging face opposite to the mating face, said terminal block comprising a first receiving cavity concaved inwardly from the mating face, a second receiving cavity concaved inwardly from the engaging face and a spaced portion partitioned the first receiving cavity and the second receiving cavity, the spaced portion defining a receiving channel receiving the terminal and an inserting slot, and the receiving channel communicating with the first receiving cavity through the inserting slot; wherein the two resilient arms can be deformed in the receiving channel of the spaced portion and have a space therebetween which is aligned with the inserted slot.

10. The electrical connector as claimed in claim 9, wherein the inserting slot extends in a second direction perpendicular to the first direction.

11. The electrical connector as claimed in claim 10, wherein the receiving channel passes through the inner face of the spaced portion to communicate with the second receiving cavity.

12. The electrical connector as claimed in claim 11, wherein a diameter of the receiving channel is smaller than that of the spaced portion thereby a supporting step is formed and the terminal comprises a pair of projections located at two rear sides of the main portion and resisting against the supporting step in assembly.

13. The electrical connector as claimed in claim 12, wherein the first receiving cavity of the terminal block defines a plurality of spaced blocks, and each two blocks together form a limiting space symmetrically located at two sides of the inserting slot.

14. The electrical connector as claimed in claim 13, wherein the terminal block defines a stepping portion and a positioning clump protruding outwardly from the out periphery of the stepping portion.

15. The electrical connector as claimed in claim 9, further comprising an elastic connecting portion received in the second receiving cavity, said elastic connecting portion defining an elastic conductive element and a contacting element electrically connecting with the elastic conductive element.

16. An electrical connector assembly comprising:

a battery defining a positive electrode thereof;

a spring located in front of said battery and electrically connected to said positive electrode; and a terminal block defining a spring holding section to hold said spring therein, and terminal holding section to receive a terminal therein under a condition that the terminal is located in front of and electrically connected with and urged forward by said spring; wherein a wireless card located in front of said terminal block, defines an edge region which extends into the terminal holding section.

17. The electrical connector as claimed in claim 16, wherein a cross-like groove structure is formed in the terminal holding area to receive the terminal and the edge region of the wireless card therein in an intersectional manner.

* * * * *